US008967770B2

(12) United States Patent
Nakano

(10) Patent No.: US 8,967,770 B2
(45) Date of Patent: Mar. 3, 2015

(54) INKJET PRINTER AND PRINTING METHOD

(75) Inventor: Masayuki Nakano, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 38 days.

(21) Appl. No.: 13/621,013

(22) Filed: Sep. 15, 2012

(65) Prior Publication Data

US 2013/0076815 A1 Mar. 28, 2013

(30) Foreign Application Priority Data

Sep. 28, 2011 (JP) ..... P2011-211785

(51) Int. Cl.
*B41J 2/145* (2006.01)

(52) U.S. Cl.
USPC ..... 347/41; 347/19; 347/14

(58) Field of Classification Search
USPC ..... 347/5, 9, 12, 19, 13, 15, 14, 41
See application file for complete search history.

(56) References Cited

U.S. PATENT DOCUMENTS

| | | | | |
|---|---|---|---|---|
| 6,428,138 | B1 * | 8/2002 | Asauchi et al. | 347/15 |
| 7,571,982 | B2 * | 8/2009 | Koase | 347/41 |
| 7,950,768 | B2 * | 5/2011 | Yoshida et al. | 347/19 |
| 8,040,556 | B2 | 10/2011 | Takemoto et al. | |
| 2003/0058290 | A1 * | 3/2003 | Tanuma | 347/13 |

FOREIGN PATENT DOCUMENTS

JP 2009-000997 A 1/2009

* cited by examiner

*Primary Examiner* — Lam S Nguyen
(74) *Attorney, Agent, or Firm* — McDermott Will & Emery LLP

(57) ABSTRACT

In a head (21) of an inkjet printer, a plurality of outlet rows are arranged in a scanning direction, the plurality of outlet rows each having a plurality of outlets arranged in a direction intersecting the scanning direction. The plurality of outlets are each capable of forming dots of a plurality of sizes on printing paper upon receiving different driving signals from an ejection control part (44). In the inkjet printer, under control of the ejection control part (44), some of the outlet rows form dots of only one size out of the plurality of sizes, and the other outlet rows form dots of only another size. In this way, causing the plurality of outlets in each outlet row to form dots of only one size makes it possible to reduce the occurrence of satellite droplets or the like and improve print quality.

16 Claims, 6 Drawing Sheets

INKJET PRINTER AND PRINTING METHOD

TECHNICAL FIELD

The present invention relates to an inkjet printer capable of forming dots of a plurality of sizes on an object, and a printing method used in the inkjet printer.

BACKGROUND ART

Inkjet printers that are provided with heads each having a plurality of outlets (nozzles) arranged therein and perform printing by controlling ON and OFF of ink droplet ejection from outlets while moving the heads relative to printing paper to perform scanning have conventionally been used. Also, in recent years, such inkjet printers have further reduced the size of ink droplets to be ejected and increased the density of outlet arrangement in order to print higher-resolution images.

In such inkjet printers, it is also known that unevenness can be caused in printed images due to crosstalk between outlets. In Japanese Patent Application Laid-Open No. 2009-997, in each outlet row having a plurality of outlets arranged in a width direction perpendicular to a scanning direction, the number of outlets included in each outlet group of successive outlets in the width direction that are in a non-operating state during printing are set to be 1 or more and a predetermined number or less, and the number of outlets included in each outlet group of successive outlets in the width direction that are not in the non-operating state during printing are set to be 1 or more and a predetermined number or less. This makes it possible to suppress the occurrence of unevenness due to crosstalk between outlets.

Incidentally, in an inkjet printer in which each outlet is capable of forming dots of a plurality of sizes, unintended satellite droplets (including misty droplets) or the like may be produced when a plurality of outlets in each outlet row form dots of different sizes. In this case, print quality of the inkjet printer is degraded.

SUMMARY OF INVENTION

The present invention is intended for an inkjet printer, and it is an object of the present invention to improve the print quality of an inkjet printer capable of forming dots of a plurality of sizes.

An inkjet printer according to the present invention includes a head having a plurality of outlet rows arranged in a predetermined scanning direction, the plurality of outlet rows each having a plurality of outlets arranged in a direction intersecting the scanning direction, a scanning mechanism for moving an object relative to the head in the scanning direction, and an ejection control part for performing control of ink ejection from the head in parallel with the movement of the object relative to the head. The plurality of outlets are each capable of forming dots of a plurality of sizes on the object upon receiving different driving signals from the ejection control part, and under control of the ejection control part, at least one of the plurality of outlet rows forms dots of only one size out of the plurality of sizes, and the other outlet row(s) forms dots of at least another size. According to the present invention, it is possible to improve print quality.

According to a preferred embodiment of the present invention, the other outlet row(s) forms dots of only a size(s) other than the one size, which makes it possible to further improve print quality.

According to another preferred embodiment of the present invention, dots of the one size are dots of a largest size out of the plurality of sizes, which makes it possible to further improve print quality.

Preferably, the plurality of outlets are each provided with a piezoelectric element.

The present invention is also intended for a printing method used in the inkjet printer.

These and other objects, features, aspects and advantages of the present invention will become more apparent from the following detailed description of the present invention when taken in conjunction with the accompanying drawings.

DESCRIPTION OF EMBODIMENTS

Figure 1:
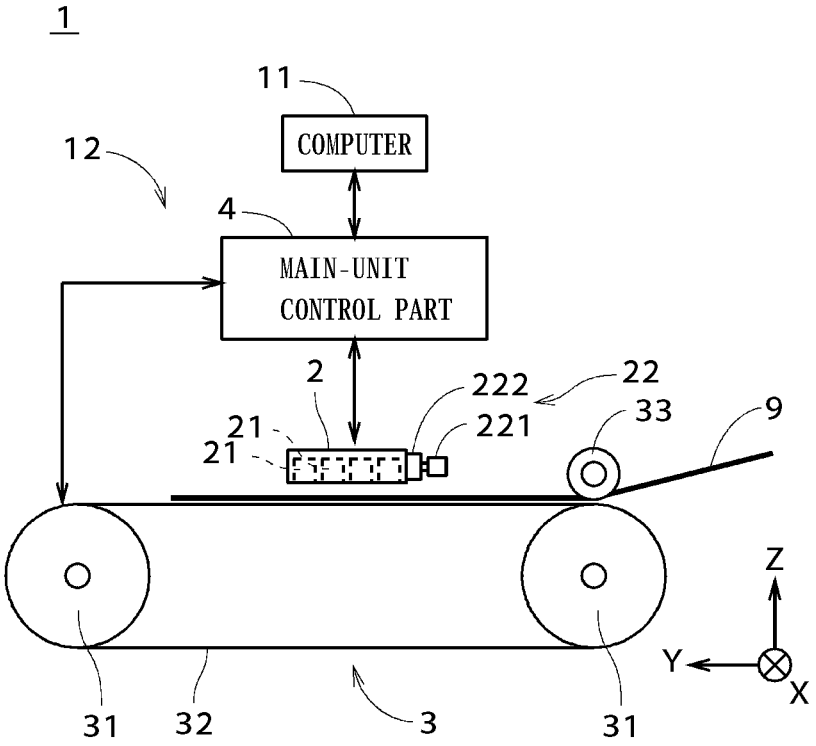
FIG. 1 shows a configuration of an inkjet printer.

FIG. 1 shows a configuration of an inkjet printer 1 according to an embodiment of the present invention. The inkjet printer 1 is an image recording apparatus that records and superimposes images of a plurality of color components on printing paper 9 that is continuous form paper. A main unit 12 of the inkjet printer 1 includes a head unit 2 that ejects fine droplets of ink toward the printing paper 9, a head moving mechanism 22 for moving the head unit 2 in the X direction in FIG. 1 along the printing paper 9, a paper feed mechanism 3 for moving the printing paper 9 in the Y direction perpendicular to the X direction under the head unit 2, and the main-unit control part 4 that is connected to the head unit 2, the head moving mechanism 22, and the paper feed mechanism 3. A computer 11 including a CPU that performs various types of computational processing, memories that store various types of information, and the like is connected to the main-unit control part 4. In the inkjet printer 1, the main unit 12 prints a halftone image (halftone dot image) on the printing paper 9 upon receiving a signal from the computer 11.

The paper feed mechanism 3 includes two belt rollers 31 that are connected to a motor not shown, and a belt 32 that runs between the two belt rollers 31. The printing paper 9 is guided and held on the belt 32 through a roller 33 provided above the belt rollers 31 on the (−Y) side and is moved to the (+Y) side, passing through under the head unit 2 together with the belt 32.

The head moving mechanism 22 is provided with a timing belt 222 formed in a long, slender ring shape that extends in the X direction. By the motor 221 reciprocally moving the timing belt 222, the head unit 2 is smoothly moved in a direction that is perpendicular to a feed direction of the printing paper 9 (the Y direction in FIG. 1, which is hereinafter also referred to as a "scanning direction") and along the printing paper 9 (X direction in FIG. 1, which is a direction corresponding to the width of the printing paper 9 and is thus hereinafter referred to as a "width direction").

Figure 2:
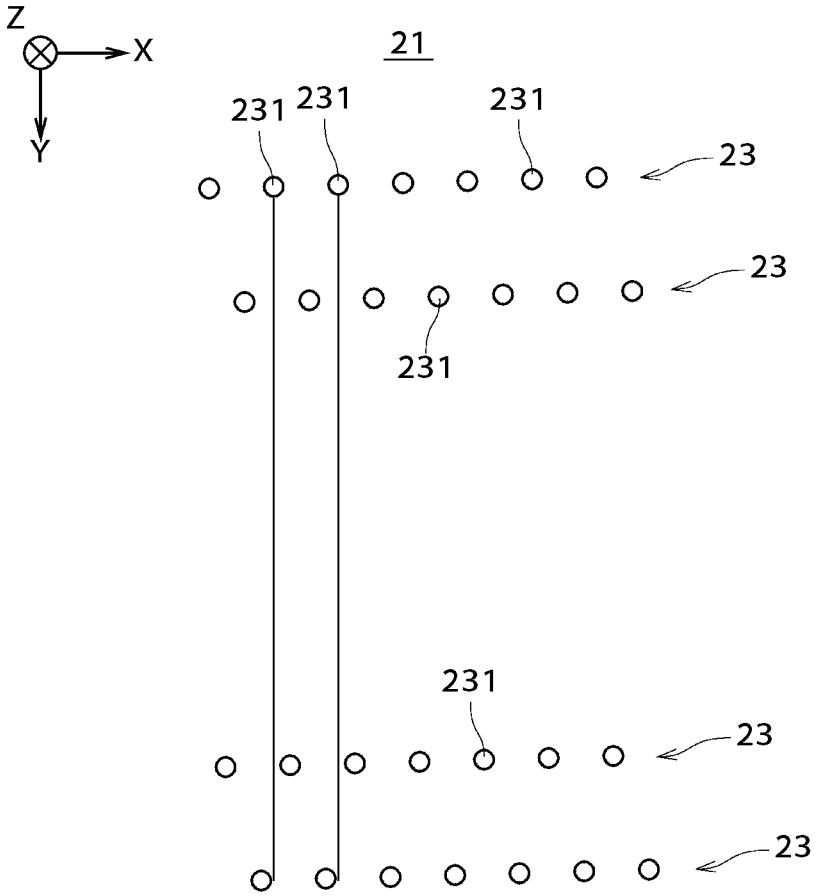
FIG. 2 shows outlet rows.

The head unit 2 has a plurality of heads 21 arranged in the Y direction, each head 21 being capable of ejecting ink of one color out of a plurality of colors. As shown in FIG. 2, a head 21 has a plurality of outlets 231 formed to a fixed size and each ejecting fine droplets of ink toward the printing paper 9 (in the (−Z) direction in FIG. 1). The outlets 231 are disposed on a plane parallel to the printing paper 9 (plane parallel to the XY plane). If a group of outlets 231 aligned in a direction that is approximately along the X direction in FIG. 2 (direction that is slightly inclined with respect to the width direction and hereinafter referred to as an "arrangement direction") is called an "outlet row 23", a plurality of (four in FIG. 2) outlet rows 23 are arranged in the scanning direction. In each outlet row 23, outlets 231 are arranged at a fixed pitch (e.g., a 0.14-mm pitch that is equivalent to 180 dots per inch (dpi)) in the arrangement direction. Note that the distance between outlet rows 23 in the scanning direction is sufficiently greater than the distance in the arrangement direction between outlets 231 in each outlet row 23.

Figure 3:
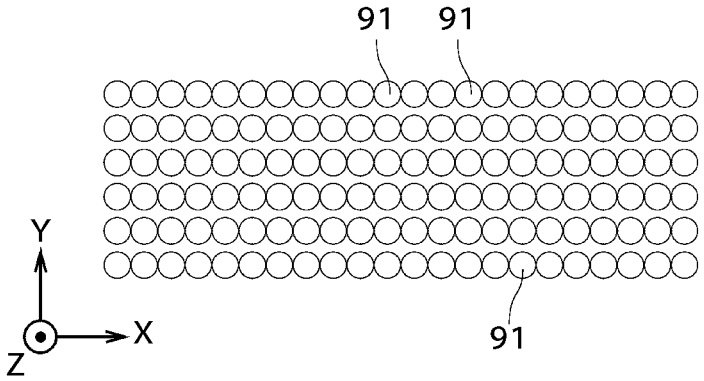
FIG. 3 shows positions where dots are formed on printing paper.

When focusing on each head 21 with respect to only the width direction, between each pair of adjacent outlets 231 in one outlet row 23 are located outlets 231 in the other outlet rows 23, one outlet each from each outlet row. Accordingly, by adjusting the timing of ink ejection from the respective outlets 231, it is possible, as shown in FIG. 3, to, at each position in the scanning direction (Y direction), form dots at a plurality of positions 91 arranged in a row in (ideally) the width direction with all the outlets 231 included in the head 21. In this way, in the inkjet printer 1, a plurality of positions in the width direction on the printing paper 9 are associated respectively with all the outlets 231 included in each head 21. Note that since the inclination of the outlet rows 23 with respect to the width direction is small, the difference in the timing of ink ejection between adjacent outlets 231 in each outlet row 23 is small.

In the heads 21, each outlet 231 is provided with a piezoelectric element and is thus capable of ejecting different amounts of fine droplets of ink therefrom by driving the piezoelectric element using driving signals having different waveforms. That is, each outlet 231 is capable of forming dots of a plurality of sizes on the printing paper 9 upon receiving different driving signals. Note that the heads 21 may be configured to eject ink using a so-called thermal method.

In reality, a plurality of outlets 231 in each outlet row 23 are aligned in the longitudinal direction of each head 21, and the arrangement of outlets 231 shown in FIG. 2 is realized by installing the head 21 in the head unit 2 with the longitudinal direction of the head 21 slightly inclined with respect to the width direction. Furthermore, a plurality of outlets 231 in each outlet row 23 are provided across the entire width of a printing area on the printing paper 9 (i.e., in a range greater than or equal to an effective printing area of the printing paper 9). Note that the head 21 does not necessarily have to be constituted by a single member and may be configured, for example, such that a plurality of head element members are arranged in both the width direction and the scanning direction so that a plurality of outlet rows 23, each having a plurality of outlets 231 aligned across the entire width of the printing area, are arranged in the scanning direction.

When the inkjet printer 1 is not performing printing, the head unit 2 is placed at a predetermined retracted position by the head moving mechanism 22, and the plurality of outlets 231 are closed with a lid member at that retracted position, which avoids clogging of the outlets 231 caused by the ink in the vicinity of the outlets being dried out. Although in the present embodiment, for the convenience of description, the head unit 2 is configured to eject ink of black, cyan, magenta, and yellow, it is, of course, possible for the inkjet printer 1 to be configured to eject ink of other color components such as light cyan.

Figure 4:
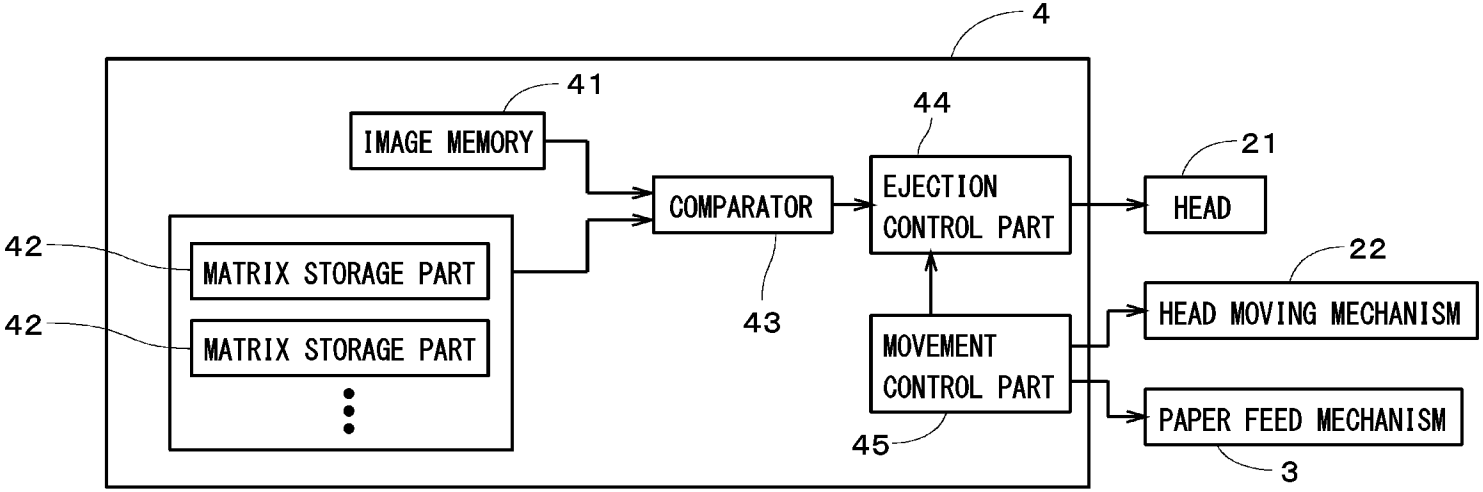
FIG. 4 is a block diagram showing a functional configuration of a main-unit control part.

FIG. 4 is a block diagram showing a functional configuration of the main-unit control part 4. The main-unit control part 4 includes an image memory 41 that stores data of an original color image, a plurality of matrix storage parts 42 (also called "screen pattern memories (SPMs)") serving as memories that respectively store threshold matrices of a plurality of color components, a comparator 43 (i.e., halftoning circuit) that compares a multi-tone original image with a threshold matrix for each color component, a movement control part 45 that controls movement of the printing paper 9 relative to the head unit 2, and an ejection control part 44 that controls ink ejection from a plurality of outlets 231 of each head 21 in synchronization with the relative movement of the printing paper 9. Note that, for the convenience of illustration, only one of the heads 21 is shown in FIG. 4.

Figure 5:
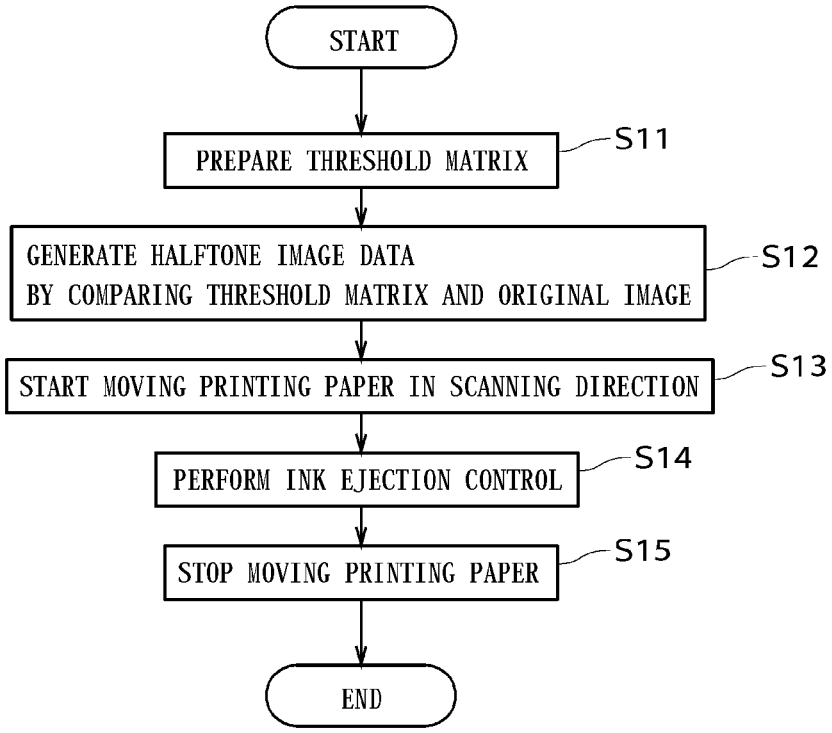
FIG. 5 is a flowchart of an operation for printing performed by the inkjet printer.

Next, an operation for printing performed by the inkjet printer 1 will be described with reference to FIG. 5. When printing is performed by the inkjet printer 1, threshold matrices to be used in actual printing are first output from the computer 11 to the main-unit control part 4 (or may be output in advance) and stored in the matrix storage parts 42 as preparation (step S11). Note that although the following description focuses on only a threshold matrix for one color among four threshold matrices that are prepared for four colors of black, cyan, magenta, and yellow, the threshold matrices for the other colors also have similar data structures and thus can be handled in a similar manner.

Figure 6:
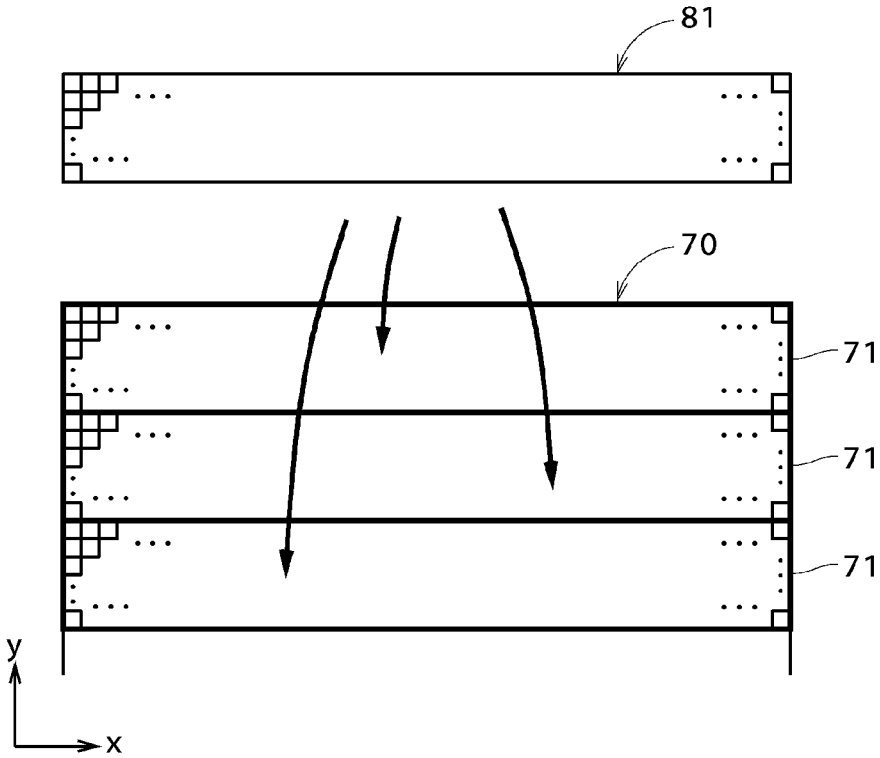
FIG. 6 is an abstract view of a threshold matrix and an original image.

FIG. 6 is an abstract view of a threshold matrix 81 and an original image 70. The threshold matrix 81 is a two-dimensional array in which a plurality of elements are arranged in both a row direction (indicated as the x direction in FIG. 6) that corresponds to the width direction and a column direction (indicated as the y direction in FIG. 6) that corresponds to the scanning direction. The number of positions in the row direction in the threshold matrix 81 (i.e. the number of elements aligned in the row direction) is the same as the number of a plurality of outlets 231 included in each head 21 in the head unit 2, and a plurality of positions in the row direction are associated respectively with the plurality of outlets 231. Note that the details of the threshold matrix will be described later.

Next, in the comparator 43 in FIG. 4 serving as an image data generation part, the original image 70 stored in the image memory 41 and the threshold matrix 81 stored in each matrix storage part 42 are compared for each color component so as to convert the original image 70 into a halftone image and generate halftone image data (hereinafter, simply referred to as the "halftone image") to be used in printing by the inkjet printer 1 (step S12).

In the original image 70, the number of pixels in the direction corresponding to the width direction (hereinafter, referred to as the "row direction" as in the threshold matrix 81) is the same as the number of positions in the row direction in the threshold matrix 81 (or the original image 70 may be converted so as to have the same number of pixels), and the original image 70 is divided in the direction corresponding to the scanning direction (hereinafter, referred to as the "column direction" as in the threshold matrix 81) so as to set iterant areas 71 (indicated by thick lines in FIG. 6) to be used as units of halftoning. At this time, the length of the iterant areas 71 in the column direction is the same as the length of the threshold matrix 81 in the column direction, and a plurality of pixels included in a single iterant area 71 correspond respectively to a plurality of elements in the threshold matrix 81.

For halftoning of the original image, the pixel value of each pixel (tone level of each pixel) in each iterant area 71 of the original image is compared with the threshold value of the corresponding element in the threshold matrix 81 so as to determine a pixel value at the position (address) of the corresponding pixel in the halftone image. Specifically, each element in the threshold matrix 81 has a threshold value for forming medium-size dot and a threshold value for forming a large-size dot that is larger than a medium-size dot. Then, in (part of) the original image 70 shown in FIG. 6, for example, a pixel value "2" is assigned to positions at which pixel values are greater than the large-size dot threshold values of their corresponding elements in the threshold matrix 81, a pixel value "1" is assigned to positions at which pixel values are greater than the medium-size dot threshold values of their corresponding elements, and a pixel value "0" is assigned to the other pixels. Note that a pixel value "2" is assigned to positions at which pixel values are greater than both the large- and medium-size dot threshold values of their corresponding elements.

In this way, the main-unit control part 4 converts the original image 70 into a halftone image using the threshold matrix 81 and generates halftone image data that indicates the amount of ink ejected from a plurality of outlets 231 during printing, which will be described later. Note that the above-described processing may be perceived as a comparison between the original image and both the threshold matrix for forming medium-size dots and the threshold matrix for forming large-size dots.

In the inkjet printer 1 in FIG. 1, when halftone image data of a portion of the original image 70 to be printed first (e.g., the iterant area 71 closest to the (+y) side) has been generated for each color, the movement control part 45 starts moving the printing paper 9 in the scanning direction by driving the paper feed mechanism 3 (step S13), and in parallel with the movement of the printing paper 9, the ejection control part 44 performs control of ink ejection from a plurality of outlets 231 included in each head 21 (step S14).

Here, since the halftone image is an image to be printed on the printing paper 9, a plurality of pixels in the halftone image can be perceived as having been set so as to be arranged on the printing paper 9. The ejection control part 44 operates in synchronization with the movement of the heads 21 relative to the printing paper 9 such that a large-size dot is formed on an ejection position on the printing paper 9 on which ink is ejected from each outlet 231 when a pixel value in the halftone image that corresponds to the ejection position is "2", a medium-size dot is formed on an ejection position when the pixel value in the halftone image that corresponds to the ejection position is "1", and no dot is formed on an ejection position when the pixel value in the halftone image that corresponds to the ejection position is "0". In this way, in the heads 21 of black, cyan, magenta, and yellow, ink ejection from each outlet 231 is controlled in accordance with a pixel value in the halftone image that corresponds to an ejection position on the printing paper 9 on which ink is ejected from the outlet 231. As a result, a color halftone image (print image) that represents an original color image is printed on the printing paper 9. When the entire halftone image has been printed on the printing paper 9, the movement of the printing paper 9 is stopped and the printing operation by the inkjet printer 1 ends (step S15).

Next is a description of processing for generating the threshold matrix 81 used in printing by the inkjet printer 1. When generating the threshold matrix 81, for example, a base matrix is prepared by repeatedly arranging a threshold array for predetermined screening in the row direction in accordance with the number of a plurality of outlets 231 in a head 21. The base matrix is the same size as the threshold matrix 81, and each element has a threshold value for a medium-size dot and a threshold value for a large-size dot. Note that a variety of threshold arrays may be used as the threshold array, examples of which include a threshold array for amplitude modulated (AM) screening in which tonal expression is realized by dot areas growing from regularly arranged dot centers, a threshold array for so-called cluster-type screening in which dot centers are irregularly arranged, and a threshold array for frequency modulated (FM) screening in which tonal expression is realized by changing the number of dot areas of a fixed size that are irregularly disposed.

Then, in the base matrix, ascending numbers starting from 1 are assigned to all positions in the row direction, for example from one end to the other in the row direction, and for all even-numbered elements in the row direction, their medium-size dot threshold values are changed to the maximum pixel value in the tonal range of the original image (e.g., 255 when the original image is expressed in the tonal range of 0 to 255). For all odd-numbered elements in the row direction, their large-size dot threshold values are changed to the maximum pixel value in the tonal range of the original image. As a result, the threshold matrix 81 to be used in the printing operation by the inkjet printer 1 is generated.

As described previously, when focusing on the head 21 in FIG. 2 with respect to only the width direction, between each pair of adjacent outlets 231 in each outlet row 23 are located outlets 231 in the other outlet rows 23, one outlet each from each outlet row. Accordingly, in the threshold matrix 81, all of the elements having numbers (4N+1) in the row direction (where N is an integer of 0 or more) are used to determine the amount of ink ejected from the outlets 231 included in one outlet row 23. That is, all of the elements having numbers (4N+1) in the row direction correspond to one outlet row 23. Similarly, all of the elements having numbers (4N+2) in the row direction correspond to another outlet row 23, all of the elements having numbers (4N+3) in the row direction correspond to yet another outlet row 23, and all of the elements having numbers (4N+4) in the row direction correspond to the remaining one outlet row 23. Therefore, all of the even-numbered elements in the row direction correspond to either of two outlet rows 23 (hereinafter, referred to as a "first outlet row group"), and all of the odd-numbered elements in the row direction correspond to either of the remaining two outlet rows 23 (hereinafter, referred to as a "second outlet row group").

For halftoning of the original image, a pixel value "1" is assigned to a position at which the pixel value in the original image is greater than the medium-size dot threshold value of the corresponding element in the threshold matrix 81. As described previously, for the even-numbered elements in the row direction, the maximum pixel value in the tonal range of the original image is assigned as their medium-size dot threshold value. For this reason, a pixel value "1" is not assigned to pixels in the halftone image that correspond to the even-numbered elements in the row direction. As a result, under control of the ejection control part 44 based on the halftone image, the outlets 231 included in the first outlet row group do not form medium-size dots on the printing paper 9 and they form only large-size dots. Similarly, since a pixel value "2" is not assigned to pixels in the halftone image that correspond to odd-numbered elements in the row direction, the outlets 231 included in the second outlet row group do not form large-size dots on the printing paper 9 and they form only medium-size dots.

Figure 7:
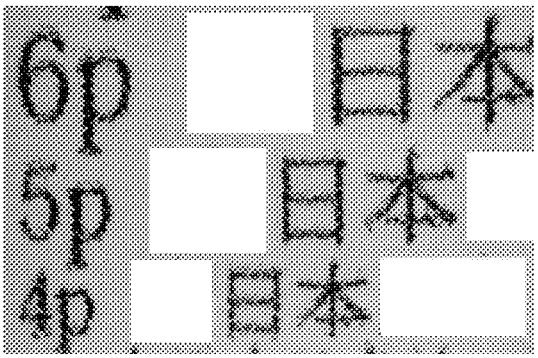
FIG. 7 shows a printed image obtained by an inkjet printer of a comparative example.

Here is a description of an inkjet printer having heads similar to the head 21 in FIG. 2 as a comparative example. In the inkjet printer of the comparative example, the above-described base matrix is used for halftoning of an original image. Thus, when ejecting ink to a plurality of positions arranged in a row in the width direction on printing paper, each outlet row in the inkjet printer of the comparative example includes both outlets that form medium-size dots and outlets that form large-size dots in accordance with the result of comparison between the original image and the base matrix. In this way, if a plurality of outlets in each outlet row almost simultaneously form dots of different sizes, a large number of unintended satellite droplets will be produced as in a printed image shown in FIG. 7 (here, line image), and therefore the quality of the printed image (i.e., print quality) is degraded. Note that although it is not clear why such a large number of satellite droplets are produced when a plurality of outlets in each outlet row form dots of different sizes, the influence caused by mixed different driving signals (crosstalk, which is interference between outlets) is thought to be a cause thereof.

Figure 8:
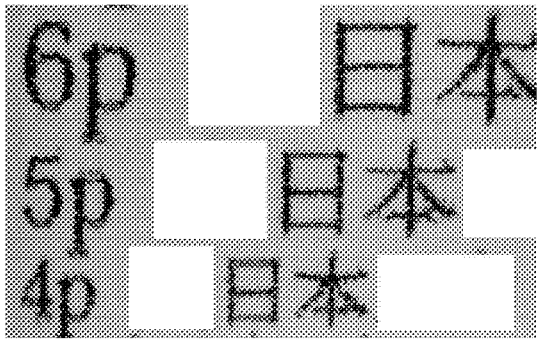
FIG. 8 shows a printed image obtained by the inkjet printer of the present invention.

FIG. 8 shows a printed image formed on the printing paper 9 by the inkjet printer 1. In the printed image in FIG. 8 that is based on a halftone image generated using the threshold matrix 81, the occurrence of satellite droplets or the like is reduced and sharper lines are formed as compared with the printed image in FIG. 7.

As described above, the inkjet printer 1 is configured such that, under control of the ejection control part 44, some of the plurality of outlet rows 23 form dots of only one size out of a plurality of sizes, and the other outlet rows 23 form dots of only another size. In this way, causing a plurality of outlets 231 in each outlet row 23 to form dots of only one size makes it possible to reduce the occurrence of satellite droplets or the like and improve print quality.

Note that since printed images obtained with the threshold matrix 81 have lower density than printed images obtained with the above-described base matrix, the density of printed images may be adjusted by reducing the large-size dot threshold values of the even-numbered elements in the row direction in the threshold matrix 81 by a fixed value and reducing the medium-size dot threshold values of the odd-numbered elements in the row direction by a fixed value. Alternatively, the inkjet printer 1 may be configured such that a threshold matrix in which the number of elements in the row direction is an integral multiple of the number of outlet rows 23 and is smaller than the number of pixels in the row direction in the original image is prepared and is then, for halftoning of the original image, repeatedly applied in the row direction so as to generate a halftone image that causes each outlet row 23 to form dots of only one size.

In the above-described exemplary processing, for example, a configuration is also possible in which the first outlet row group forms only large-size dots and the second outlet row group forms both medium- and large-size dots. In this case as well, print quality can be improved to some extent by the first outlet row group forming dots of only one size. As described above, in the inkjet printer 1, it is sufficient for some of a plurality of outlet rows 23 to form dots of only one size out of a plurality of sizes and for the other outlet rows 23 to form dots of at least another size.

Figure 9:
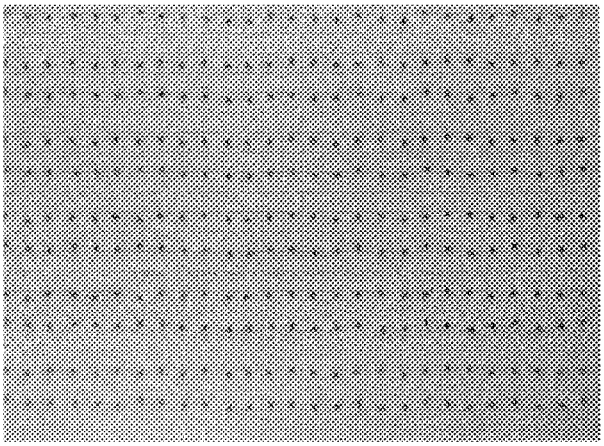
FIGS. 9 and 10 show printed images obtained by the inkjet printer of the comparative example.

Incidentally, even in the case where a plurality of outlets 231 in each outlet row 23 form dots of only the same size, there are cases in which print quality is slightly degraded if all of the outlet rows 23 form dots of the same size. For example, if each row of dots arranged at a predetermined interval in the width direction is formed on the printing paper 9 using all of the outlet rows 23 that form only large-size dots, there are cases in which, as shown in FIG. 9, the positions of dots included in one row are slightly misaligned (i.e., the line extending in the width direction is bent) in the scanning direction (vertical direction in FIG. 9). Accordingly, in a printed image (line image) shown in FIG. 10 that has been recorded by all of the outlet rows 23 forming only large-size dots, a slight blur occurs in a portion (indicated by B1 in FIG. 10) that extends linearly in the width direction (horizontal direction in FIG. 10). Note that it is not clear why print quality is degraded when all of the outlet rows 23 form only large-size dots.

Figure 10:
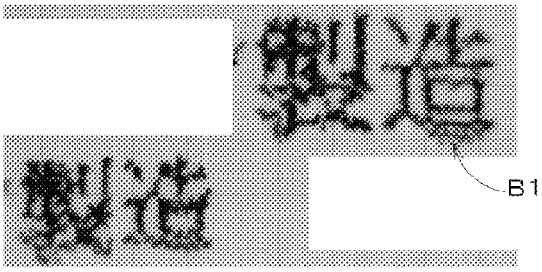

As described previously, for example in the case where the first outlet row group forms only large-size dots and the second outlet row group forms both medium- and large-size dots, there is a possibility that, depending on an image to be printed, most dots will be the large size and a phenomenon similar to that occurring in the printed image shown in FIG. 10 will occur.

Figure 11:
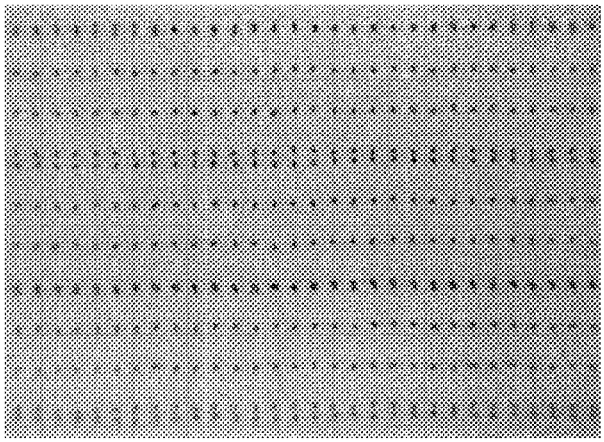
FIGS. 11 and 12 show printed images obtained by the inkjet printer of the present invention.
Figure 12:
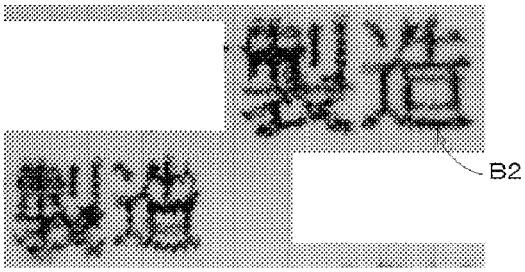

On the other hand, in the case where each row of dots arranged at a predetermined interval in the width direction is formed on the printing paper 9 using only one outlet row 23 that forms only large-size dots, the phenomenon in which the positions of dots included in one row are misaligned can be suppressed as shown in FIG. 11. Note that in FIG. 11, outlet rows 23 to be used when forming dots are switched every three rows. Accordingly, if, as in the above-described embodiment, outlet rows 23 that are used to form large-size dots among a plurality of outlet rows 23 are limited to the first outlet row group and the remaining outlet rows 23 (second outlet row group) are set to form only medium-size dots, it is possible to suppress the occurrence of a blur in a portion extending linearly in the width direction (indicated by B2 in FIG. 12) in a printed image in FIG. 12 that records characters similar to those in FIG. 10. The same applies in the case where print quality is degraded when all of the outlet rows 23 form medium-size dots.

As described above, if print quality is degraded when all of the outlet rows 23 form dots of the same size, it is preferable to limit the number of outlet rows 23 that are used to form dots of that size (this can be perceived as thinning dots of that size). In other words, it is preferable for some of a plurality of outlet rows 23 to form dots of only that size and for each of the other outlet rows 23 to form dots of a size(s) other than that size. This makes it possible to suppress flying off of ink droplets or the like and further improve print quality (the same applies in a later-described example in which each outlet 231 is capable of forming small-, medium-, and large-size dots).

Each outlet 231 in the inkjet printer 1 may be capable of forming, in addition to medium- and large-size dots, small-size dots that are smaller than the medium- and large-size dots. In this case, for example, each element in the above-described base matrix has a threshold value for a small-size dot, a threshold value for a medium-size dot, and a threshold value for a large-size dot. Then, the small- and medium-size dot threshold values of all of the elements that correspond to the first outlet row group are changed to the maximum pixel value in the tonal range of the original image, and the large-size dot threshold values of all of the elements that correspond to the second outlet row group are changed to the maximum value in the tonal range of the original image, so as to generate a threshold matrix.

Under control of the ejection control part 44 based on a half image generated using the threshold matrix, the outlets 231 included in the first outlet row group do not form small- and medium-size dots on the printing paper 9 and they form only large-size dots. Also, the outlets 231 included in the second outlet row group do not form large-size dots on the printing paper 9 and they form only small- and medium-size dots. As a result, a high-quality print image can be formed on the printing paper 9.

Note that the second outlet row group may form small-, medium-, and large-size dots depending on the required print quality. Alternatively, a plurality of outlet rows 23 in a head 21 may include, in addition to the outlet rows 23 that form only large-size dots, outlet rows 23 that form only small-size dots, outlet rows 23 that form only medium-size dots, outlet rows 23 that form only small- and large-size dots, or outlet rows 23 that form only medium- and large-size dots. Moreover, each outlet 231 may be capable of forming dots of four or more sizes.

While the above has been a description of an embodiment of the present invention, the present invention is not intended to be limited to the above-described embodiment, and can be modified in various ways.

Although in the above-described embodiment, two outlet rows 23 are set to form dots of only one size, one or three or more outlet rows 23 may be set to form dots of only one size. That is, what is important for the inkjet printer 1 is that at least one of a plurality of outlet rows 23 forms dots of only one size out of a plurality of sizes, and the other outlet row(s) 23 forms dots of at least another size.

In the above-described embodiment, a configuration is also possible in which at least one of a plurality of outlet rows 23 form only medium-size (or small-size) dots, and the other outlet rows 23 form dots of at least another size. However, since dots of the largest size out of a plurality of sizes will have great influence on print quality, from the viewpoint of further improving print quality, it is preferable for at least one of a plurality of outlet rows 23 to form dots of only the largest size and for the other outlet rows 23 to form dots of at least another size.

The control under which at least one outlet row 23 forms dots of only one size and the other outlet rows 23 form dots of at least another size may be implemented using a method other than the method of using the threshold matrix 81 obtained by changing the threshold values. For example, in the case where a halftone image is generated using a base matrix and a driving signal to be input to each outlet 231 is generated in accordance with the halftone image, the ejection control part 44 may change the driving signal to be input to each outlet 231 so that at least one outlet row 23 forms dots of only one size and the other outlet rows 23 form dots of at least another size.

Although in the inkjet printer 1, at each position in the scanning direction on the printing paper 9, a row of dots arranged in the width direction is formed using all of the outlet rows 23, a configuration is also possible in which, for example, a row of dots formed using the two outlet rows 23 on the (−Y) side in the head 21 of FIG. 2 and a row of dots formed using the two outlet rows 23 on the (+Y) side are alternately arranged in the scanning direction. In this case, the positions of dots in the width direction differ between adjacent rows of dots in the scanning direction. Of course, the positions of dots in the width direction may be matched between adjacent rows of dots in the scanning direction by disposing the outlets 231 in the two outlet rows 23 on the (−Y) side and the outlets 231 in the two outlet rows 231 on the (+Y) side at the same positions in the width direction.

The number of outlet rows 23 in a head 21 may be set to any value of two or more. Moreover, a plurality of outlets 231 in each outlet row 23 may be arranged in parallel with the width direction, and it is sufficient for a plurality of outlets 231 to be arranged in a direction intersecting the scanning direction.

Although in the inkjet printer 1, the printing paper 9 is moved in the scanning direction relative to the heads 21 by the paper feed mechanism 3 serving as a scanning mechanism, it is possible to provide a scanning mechanism for moving the heads 21 in the Y direction. A configuration is also possible in which the printing paper 9 is held by a roller and moved in the scanning direction relative to the heads 2 by a motor that rotates the roller. In this way, a scanning mechanism for moving the printing paper 9 in the scanning direction relative to the heads 21 can be implemented with various configurations.

The inkjet printer may be configured to print an image on a printing paper in sheet form. For example, an inkjet printer that holds a printing paper on a stage is configured such that, with respect to the width direction, the width along which a plurality of outlets are arranged is set to be narrower than the printing area of the printing paper, and a scanning mechanism is provided for moving heads relative to the printing paper in both the scanning direction and the width direction. Then, the heads move in the scanning direction relative to the printing paper while ejecting ink (main scanning), then move in the width direction by a predetermined distance relative to the printing paper after having reached the edge of the printing paper (sub-scanning), and thereafter move in a direction of the scanning direction opposite to the previous main scanning relative to the printing paper while ejecting ink. In this way, as a result of the heads moving in the scanning direction relative to the printing paper for main scanning and intermittently moving in the width direction for sub-scanning every time the main scanning is complete, the above-described inkjet printer prints an image on the entire printing paper.

An object to be printed by the inkjet printer 1 may be other than the printing paper 9 and may, for example, be a plate- or film-like base material made of plastic or the like.

The configurations of the above-described preferred embodiments and variations may be appropriately combined as long as there are no mutual inconsistencies.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2011-211785 filed in the Japan Patent Office on Sep. 28, 2011, the entire disclosure of which is incorporated herein by reference.

REFERENCE SIGNS LIST

1 Inkjet printer
3 Paper feed mechanism
9 Printing paper
21 Head
23 Outlet row
44 Ejection control part
231 Outlet
S13 to S15 Step

The invention claimed is:

1. An inkjet printer comprising:

a head having a plurality of outlet rows arranged in a predetermined scanning direction, said plurality of outlet rows each having a plurality of outlets arranged in a direction intersecting said scanning direction, said plurality of outlets in each outlet row being provided across the entire width of a printing area on an object with respect to a width direction perpendicular to said scanning direction, wherein when focusing on said head with respect to said width direction, between each pair of adjacent outlets in one outlet row, one outlet from each of the other outlet rows is provided;

a scanning mechanism for moving said object relative to said head in said scanning direction; and an ejection control part for performing control of ink ejection from said head in parallel with the movement of said object relative to said head, wherein:

said plurality of outlets are each capable of forming dots of a plurality of sizes on said object upon receiving different driving signals from said ejection control part, under control of said ejection control part, at least one outlet row of said plurality of outlet rows in said head forms dots of only one size out of said plurality of sizes, and the other outlet row(s) forms dots of at least another size, a driving signal for said one size having a different waveform from that of a driving signal for said another size, the control by said ejection control part is performed based on a halftone image generated by comparing an original image with a threshold matrix, said threshold matrix has a plurality of positions in a row direction which are associated respectively with a plurality of outlets included in said head, said row direction corresponding to said width direction, each element in said threshold matrix has threshold values for forming dots of said plurality of sizes, and values to form no dot are assigned to elements corresponding to said at least one outlet row as threshold values for forming dots of size(s) other than said one size.

2. The inkjet printer according to claim 1, wherein said other outlet row(s) forms dots of only a size(s) other than said one size.

3. The inkjet printer according to claim 2, wherein dots of said one size are dots of a largest size out of said plurality of sizes.

4. The inkjet printer according to claim 3, wherein said plurality of outlets are each provided with a piezoelectric element.

5. The inkjet printer according to claim 2, wherein said plurality of outlets are each provided with a piezoelectric element.

6. The inkjet printer according to claim 1, wherein dots of said one size are dots of a largest size out of said plurality of sizes.

7. The inkjet printer according to claim 6, wherein said plurality of outlets are each provided with a piezoelectric element.

8. The inkjet printer according to claim 1, wherein said plurality of outlets are each provided with a piezoelectric element.

9. The inkjet printer according to claim 1, wherein each outlet row in said head is inclined with respect to said width direction.

10. The inkjet printer according to claim 9, wherein a longitudinal direction of said head is inclined with respect to said width direction.

11. A printing method used in an inkjet printer, comprising the steps of:

a) moving an object relative to a head in a predetermined scanning direction, said head having a plurality of outlet rows arranged in said scanning direction, said plurality of outlet rows each having a plurality of outlets arranged in a direction intersecting said scanning direction, said plurality of outlets in each outlet row being provided across the entire width of an printing area on said object with respect to a width direction perpendicular to said scanning direction, wherein when focusing on said head with respect to said width direction, between each pair of adjacent outlets in one outlet row, one outlet from each of the other outlet rows is provided; and b) performing control of ink ejection from said head in parallel with said step a), wherein:

said plurality of outlets are each capable of forming dots of a plurality of sizes on said object upon receiving different driving signals, in said step b), at least one outlet row of said plurality of outlet rows in said head forms dots of only one size out of said plurality of sizes, and the other outlet row(s) forms dots of at least another size, a driving signal for said one size having a different waveform from that of a driving signal for said another size, the control in said step b) is performed based on a halftone image generated by comparing an original image with a threshold matrix, said threshold matrix has a plurality of positions in a row direction which are associated respectively with a plurality of outlets included in said head, said row direction corresponding to said width direction, each element in said threshold matrix has threshold values for forming dots of said plurality of sizes, and values to form no dot are assigned to elements corresponding to said at least one outlet row as threshold values for forming dots of size(s) other than said one size.

12. The printing method according to claim 11, wherein said other outlet row(s) forms dots of only a size(s) other than said one size.

13. The printing method according to claim 12, wherein dots of said one size are dots of a largest size out of said plurality of sizes.

14. The printing method according to claim 11, wherein dots of said one size are dots of a largest size out of said plurality of sizes.

15. The printing method according to claim 11, wherein each outlet row in said head is inclined with respect to said width direction.

16. The printing method according to claim 15, wherein a longitudinal direction of said head is inclined with respect to said width direction.

* * * * *